US007159361B1

(12) United States Patent
Hale, Jr.

(10) Patent No.: US 7,159,361 B1
(45) Date of Patent: Jan. 9, 2007

(54) PET DOOR PANEL INSERT

(76) Inventor: Seymour B. Hale, Jr., 4895 Autumn Creek Dr., Canon City, CO (US) 81212

( * ) Notice: Subject to any disclaimer, the term of this patent is extended or adjusted under 35 U.S.C. 154(b) by 327 days.

(21) Appl. No.: 10/880,883

(22) Filed: Jun. 30, 2004

(51) Int. Cl.
*E06B 3/68* (2006.01)
*E06B 7/00* (2006.01)

(52) U.S. Cl. ..... 49/169; 49/55; 49/57

(58) Field of Classification Search ..... 160/180, 160/2; 49/463, 169, 50, 55, 56, 57; 52/455, 52/504

See application file for complete search history.

(56) References Cited

U.S. PATENT DOCUMENTS 4,047,331 A * 9/1977 Davlantes ..... 49/171
4,344,255 A * 8/1982 Knoll ..... 49/501
5,185,954 A * 2/1993 Waddle, Sr. ..... 49/168
5,946,855 A * 9/1999 Miconi ..... 49/163
6,272,793 B1 * 8/2001 Davlantes ..... 49/168
6,691,483 B1 * 2/2004 Lethers ..... 52/455

* cited by examiner

*Primary Examiner*—Hugh B. Thompson, II
*Assistant Examiner*—Candace Bradford
(74) *Attorney, Agent, or Firm*—Hugh D. Jaeger, Esq.

(57) ABSTRACT

A pet door panel insert which has a vertically expandable panel assembly in the upper region thereof installs in a sliding glass patio door or other entity arrangement simply without complicated tools. A positionable structure in the expandable panel assembly is controllingly spaced from a stationary structure of the expandable panel assembly and is actuated upwardly to engage the upper structure of a door frame to sturdily affix the pet door panel insert within the door frame. Opposed vertically adjustable front and rear cover slide plates are frictionally engaged by the upper region of a framework to seal the expandable panel assembly against the outside environment.

29 Claims, 7 Drawing Sheets

PET DOOR PANEL INSERT

CROSS REFERENCES TO RELATED APPLICATIONS

None.

BACKGROUND OF THE INVENTION

1. Field of the Invention

The present invention is related to door structures, but in particular, pertains to a self-contained structure allowing for ingress or egress of a domestic animal such as a dog, cat or other suitably sized animal through a pet door panel insert which adjustingly and without special tools installs primarily in sliding glass patio door structures, but can be installed adjacent to a hinged door having adjacent side panels or in a window.

2. Description of the Prior Art

Prior art pet entry structures include pet door panel inserts which adaptingly install in existing human entry door structures, such as a sliding glass patio door. Many such structures were an after market add-on device and, as such, the construction thereof was not of the same sturdiness and robustness as the structures designed for installation along with initial door installation. To be readily accommodated in a door frame, some inserts incorporated a spring loaded panel top which allowed a pet door panel insert to be installed on a temporary basis without having to install a pet door panel insert permanently. A drawback of this type of installation is that the pet door panel insert may be loose in the frame and may not provide a tight and sturdy installation. Other devices of more permanent design required accurate cutting and drilling in order to size the framework of the pet door panel insert to a door frame. Such custom sizing did not guarantee reuse of the pet door panel insert for installation at another door frame site as prior cutting and drilling may have rendered the structure unusable in a door frame of different dimension. What is needed is a pet door panel insert which can be easily and sturdily installed in an existing door frame without the use of drills, saws or other special tools, and which can be installed or reinstalled in door frames without damaging the pet door panel insert or the door frame.

SUMMARY OF THE INVENTION

The general purpose of the present invention is to provide a pet door panel insert. The pet door panel insert can be installed preferably in sliding glass patio door arrangements having a stationary door panel and an operator door panel, but can also be substituted for a panel of a door or a panel in a panel array and can even be installed in windows. The pet door panel insert includes a lower entry panel of any suitable composition and structure as known in the art, such as one or more flexible plastic panels, rigid or flexible swinging panels, spring loaded doors and the like, located at the lower region of a framework; an expandable panel assembly at the upper region of the framework; and one or more mid-panels, preferably of safety glass, but alternatively of clear plastic, wood, screen or other suitable material, located between vertically and horizontally aligned channels of the framework and between the lower entry panel and the expandable panel assembly. The pet door panel insert can be installed between the stationary door panel and adjacent door frame members at the stationary door panel end or against the door frame adjacent to the door frame members at the operator door panel end. A bottom framework channel of the pet door panel insert rests on the sill or existing track of the door frame, and one of the vertically aligned framework side channels aligns to either of the door jambs. The vertically expandable panel assembly is slidably engaged and positionably and expandingly adjustable in the upper portions of vertically aligned side channels of the framework and is incorporated to secure and to fix the top of the pet door panel insert to an existing channel or track at the top of the door frame.

According to one or more embodiments of the present invention, there is provided a framework having opposed vertically aligned left side and right side channels, a plurality of fixed horizontally aligned cross channels extending between the vertically aligned left and right side channels, a bottom engagement channel, a pet entry framework and pet door located at the lower region of the framework, and an expandable panel assembly slidably engaged and positionably adjustable between the upper vertical portions of the vertically aligned left and right side channels of the framework. The expandable panel assembly includes opposed vertically aligned left and right sleeve channels slidably engaged within the upper regions of the opposed vertically aligned left and right side channels, a deep extended wall cross channel engaging a filler panel where the filler panel extends between and slidingly engages opposed vertically aligned left and right sleeve channels, an apertured plate secured to the top of the filler panel, a horizontally aligned top engagement channel secured to the tops of the opposing vertically aligned left and right sleeve channels, opposed elongated machine screws threadingly engaged with stationary nuts captive within lower regions of the top engagement channel and extending downwardly from the top engagement channel to engage opposed adjustable nuts and further extending through the apertured plate to engage elongated body holes in the filler panel, and opposed front and rear cover slide plates extending between and adjustably fixed between opposed angled interior edges of the opposed vertically aligned left and right side channels. Various other horizontally aligned cross channels extend between the opposed vertically aligned left and right side channels and collectively provide for mutual full or partial support for a window panel, the expandable panel assembly, and other components of or associated with the invention. Sealing strips, gaskets and the like are incorporated throughout and within.

One significant aspect and feature of the pet door panel insert is an expandable panel assembly which is vertically positionable to accommodate door frame height.

One significant aspect and feature of the pet door panel insert is an expandable panel assembly having stationary structure and positionable structure where such structure is accessible from a standing position.

Still another significant aspect and feature of the pet door panel insert is the provision of elongated machine screws and adjustment nuts to position the positionable structure with respect to the stationary structure, thereby providing a pet door insert which can be adjustably installed within an existing framework.

Yet another significant aspect and feature of the pet door panel insert is its capability of being installed adjacent to an operator door panel or adjacent to a stationary door panel.

A further significant aspect and feature of the pet door panel insert is its capability to be installed without the use of complicated tools.

Another significant aspect and feature of the pet door panel insert is that it is reusable in another installation, as no cutting of framework members is required.

A still further significant aspect and feature of the pet door panel insert is vertically positionable front and rear cover slide plates frictionally engaged between the upper regions of a framework for covering elements of the positionable structure.

Having thus briefly described an embodiment of the present invention and set forth some significant aspects and features thereof, it is the principal object of the present invention to provide a pet door panel insert.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
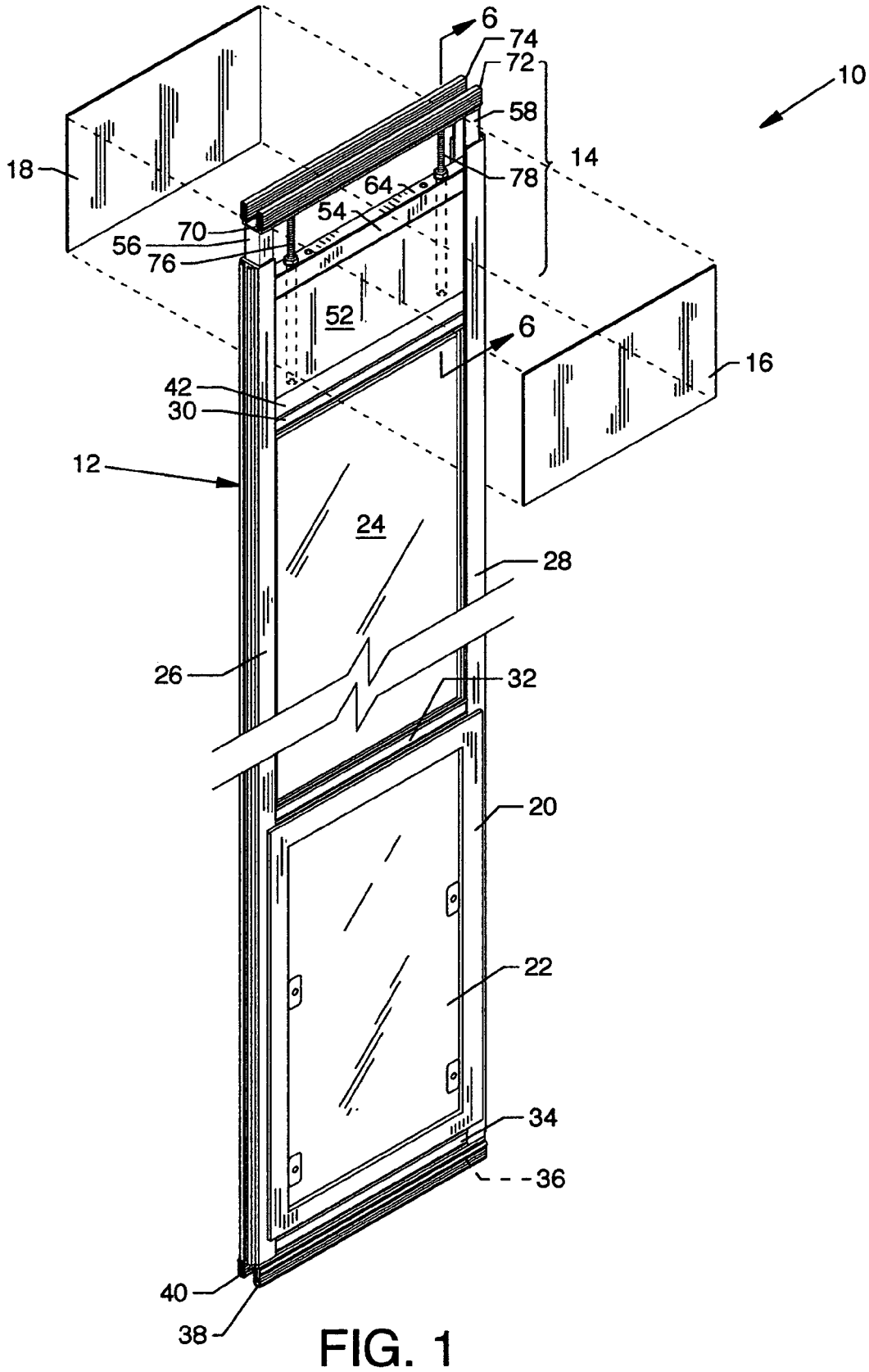
FIG. 1 is a foreshortened isometric front view of the pet door panel insert, the present invention.

FIG. 1 is a foreshortened isometric front view of the pet door panel insert 10, the present invention. Readily observed major components, structures and other features of the invention include a framework 12, an expandable panel assembly 14 at the upper region of the framework 12, front and rear cover slide plates 16 and 18, respectively, shown distanced from the general structure of the pet door panel insert 10, a pet entry framework 20 located at the lower region of the framework 12 having a flexible or otherwise configured pet door 22 allowing passage of a pet through the lower structure of the pet door panel insert 10, and one or more window panels 24, preferably of safety glass, clear plastic or other suitable material, fixed between the members of the framework. The framework 12 includes a plurality of extruded channels having extruded full length screw acceptance bores. The plurality of channels includes opposed vertically aligned left and right side channels 26 and 28, respectively, and a plurality of horizontally aligned cross channels extending between the inner edges of the left and right side channels 26 and 28 and suitably fixed such as by the use of screws therebetween. The plurality of horizontally aligned cross channels include a top cross channel 30, a lower region cross channel 32 located between the window panel 24 and the pet entry framework 20, and a bottom cross channel 34. A horizontally aligned bottom engagement channel 36, which aligns to the structure of a door sill, suitably attaches, such as by screws, to the underside of the bottom cross channel 34. Weatherstrips 38 and 40 frictionally engage the horizontally oriented structure of the bottom engagement channel 36 and are incorporated to provide a seal with the structure of a door sill.

Figure 2:
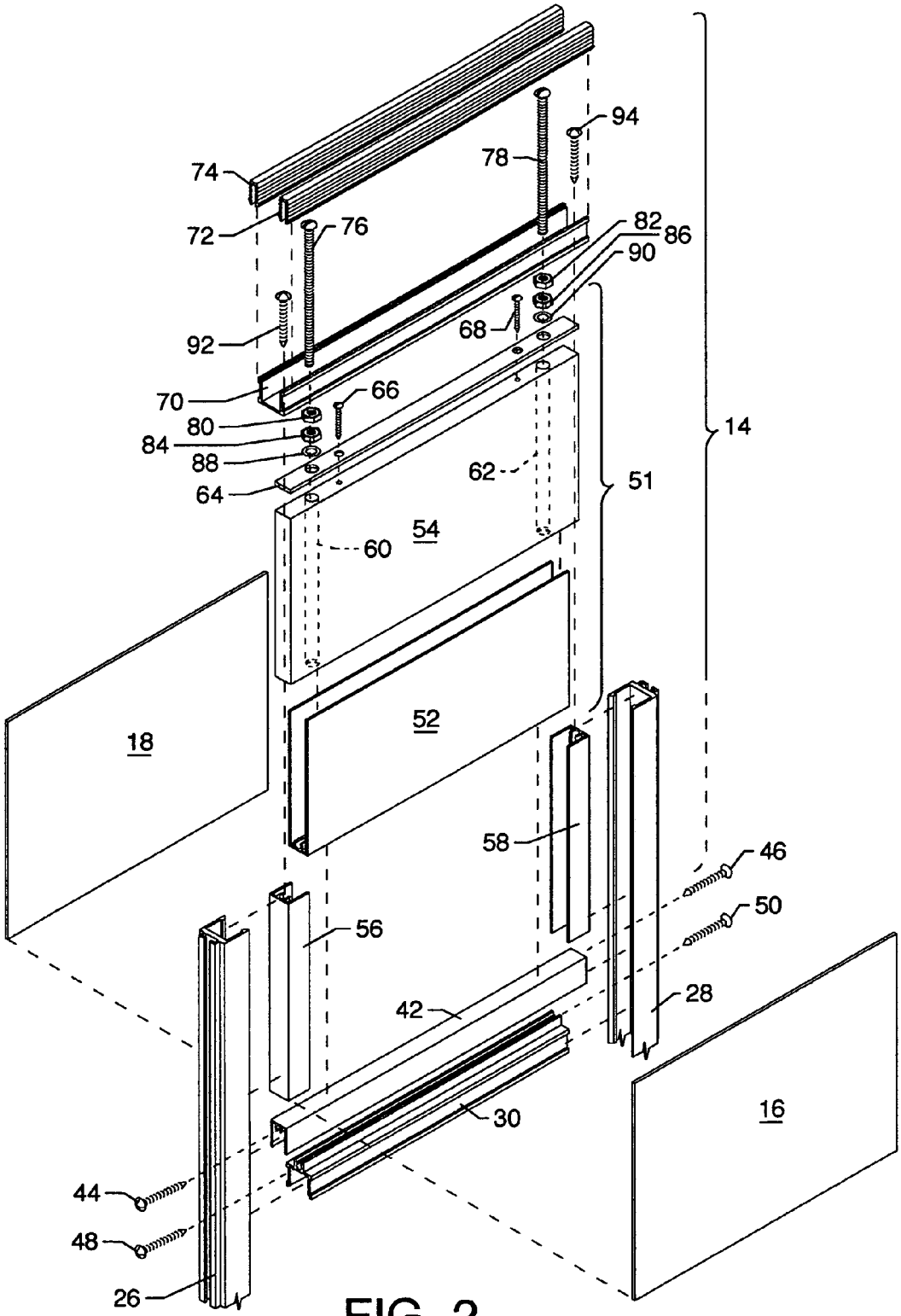
FIG. 2 is an exploded isometric front view of the expandable panel assembly shown with the upper regions of the left side channel and the right side channel, the front cover slide plate, the rear cover slide plate, and other closely associated components.
Figure 3:
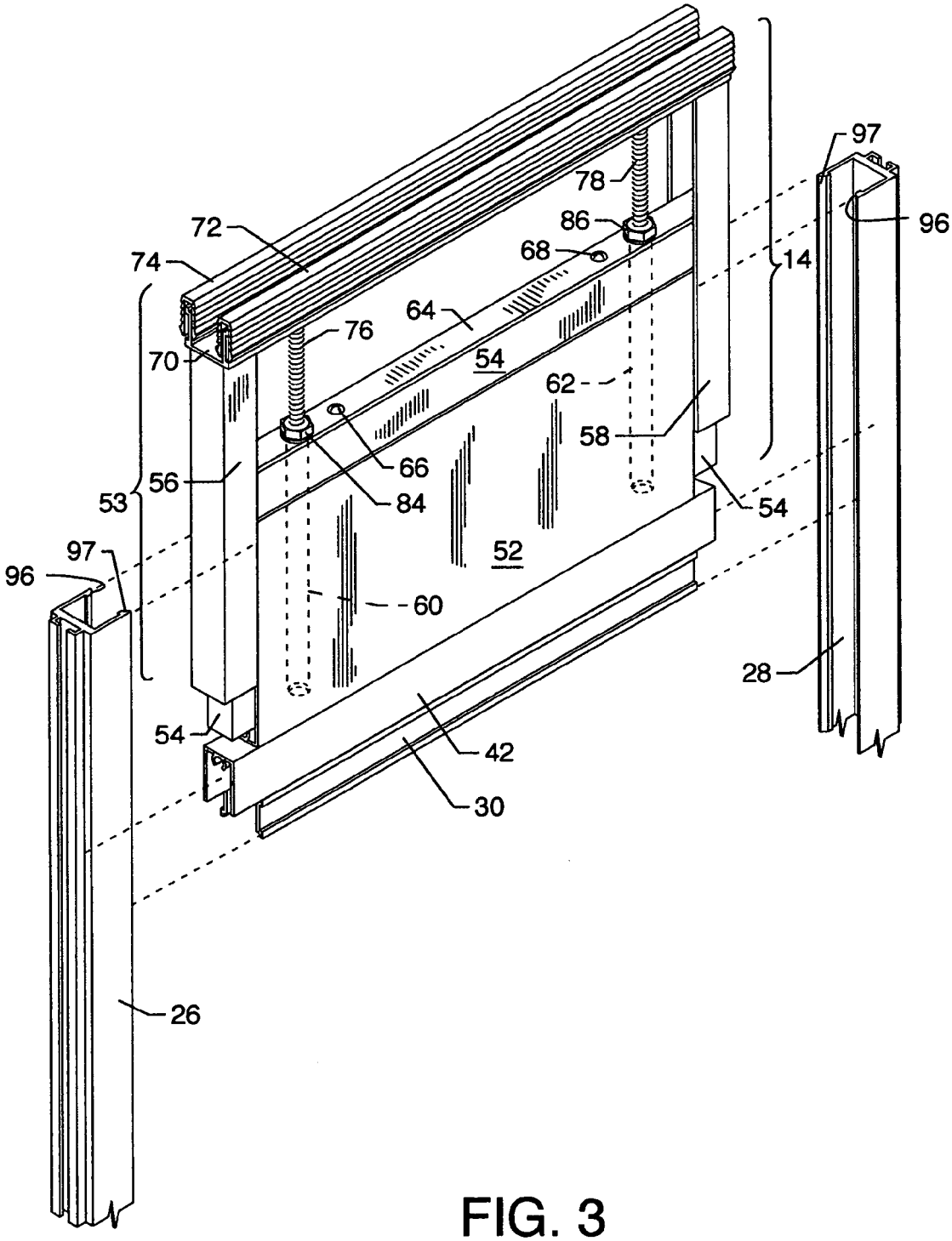
FIG. 3 is an assembled isometric front view of the elements of FIG. 2, excluding the front and rear cover slide plates.

FIG. 2 is an exploded isometric front view of the expandable panel assembly 14 shown with the upper regions of the left side channel 26 and the right side channel 28, the front cover slide plate 16, the rear cover slide plate 18, and other closely associated components. FIG. 3 is an assembled isometric view of the elements of FIG. 2 excluding the front and rear cover slide plates. With reference to FIGS. 2 and 3, the expandable panel assembly 14 and associated structure at the upper region of the pet door panel insert 10 is further described. In addition to the top cross channel 30 extending between the inner edges of the left side channel 26 and the right side channel 28, a horizontally aligned full length top cross channel 42 extends between the innermost regions of the left side channel 26 and the right side channel 28 and is suitably secured therein and thereto by screws 44 and 46 extending respectively through the left side channel 26 and the right side channel 28 and thence into a screw acceptance bore in the full length top cross channel 42. Screws 48 and 50 secure the top cross channel 30 to the left side channel 26 and the right side channel 28 in a similar manner. The screws 44, 46, 48 and 50 serve not only to secure the upper structure but also are utilized indirectly, as described later in detail, to provide for securing of the front cover slide plate 16 and the rear cover slide plate 18 over and about major portions of the expandable panel assembly 14. As shown in FIG. 3, the expandable panel assembly 14 aligns between the upper regions or ends of the left side channel 26 and the right side channel 28 and is expandable vertically therefrom to extend and mate with the upper structure of a door frame. The expandable panel assembly 14 includes stationary structure 51, best shown in FIG. 2, and positionable structure 53, best shown in FIG. 3. The stationary structure 51 includes an upwardly opening extended wall cross channel 52 and a filler panel 54 of suitable thickness and material, such as, but not limited to, plastic, wood and the like, having a greater vertical length than the extended wall cross channel 52. The filler panel 54 is accommodated by the extended wall cross channel 52 and also has a greater horizontal length than the extended wall cross channel 52 such that the ends of the filler panel 54 extend beyond the end edges of the extended wall cross channel 52 for sliding accommodation by positionable structure including the left sleeve channel 56 and the right sleeve channel 58. The filler panel 54 includes vertically oriented elongated body holes 60 and 62 extending vertically therethrough. An apertured plate 64 secures to the upper surface of the filler panel 54 by screws 66 and 68. Hardware items including a left adjustment nut 84, a right adjustment nut 86, a left lock washer 88, and a right lock washer 90 are also part of the stationary structure 51.

Figure 4:
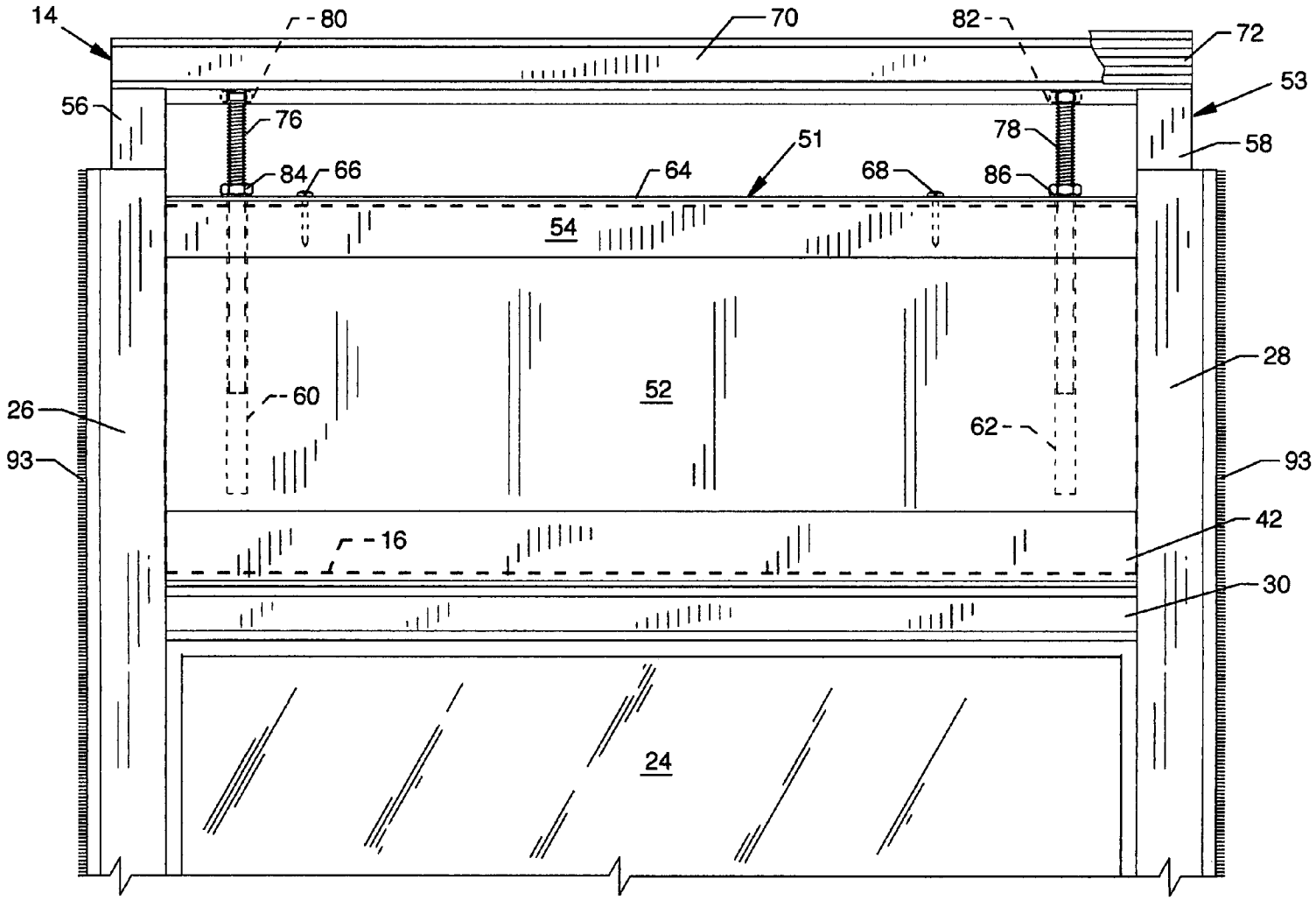
FIG. 4 is a front view of the expandable panel assembly including the upper regions of the left side channel and the right side channel.

The positionable structure 53, best shown in FIG. 3, includes the left sleeve channel 56, the right sleeve channel 58, a top engagement channel 70, weatherstrips 72 and 74, elongated machine screws 76 and 78, and in FIG. 2 other hardware items including a left nut 80, a right nut 82, and screws 92 and 94. The elongated machine screws 76 and 78 provide for vertical adjustable expansion of the expandable panel assembly 14 by variably positioning the positionable structure 53 with respect to the stationary structure 51. The elongated machine screws 76 and 78 extend through the top engagement channel 70 and are firmly fixed therein by left and right nuts 80 and 82 which are captured within the slotted under region of the top engagement channel 70, such as shown in FIG. 4, and extend further through left and right adjustment nuts 84 and 86 and lock washers 88 and 90, respectively, and through the apertured plate 64 to be accommodated by the body holes 60 and 62 of the filler panel 54. The expandable panel assembly 14 is supported along the horizontal by intimate contact of the extended wall cross channel 52 with the full length top cross channel 42 and along the vertical by slidable engagement of the left sleeve channel 56 and the right sleeve channel 58, respectively, with the upper regions of the left side channel 26 and the right side channel 28, as also shown in FIG. 4.

FIG. 4 is a front view of the expandable panel assembly 14 including the upper regions of the left side channel 26 and the right side channel 28. Shown in particular is the alignment of the expandable panel assembly 14 between the upper regions of the opposed left side channel 26 and the right side channel 28. More specifically, the left sleeve channel 56 is shown in captured alignment with the left side channel 26 and the right sleeve channel 58 is shown in captured alignment with the right side channel 28. The front cover slide plate 16 is shown in dashed lines in alignment between the angled interior edges 96 and 97 (FIGS. 3 and 5) and against the extended wall cross channel 52. Weatherstripping 93 is captured in external grooves in the opposed left side channel 26 and right side channel 28.

Figure 5:
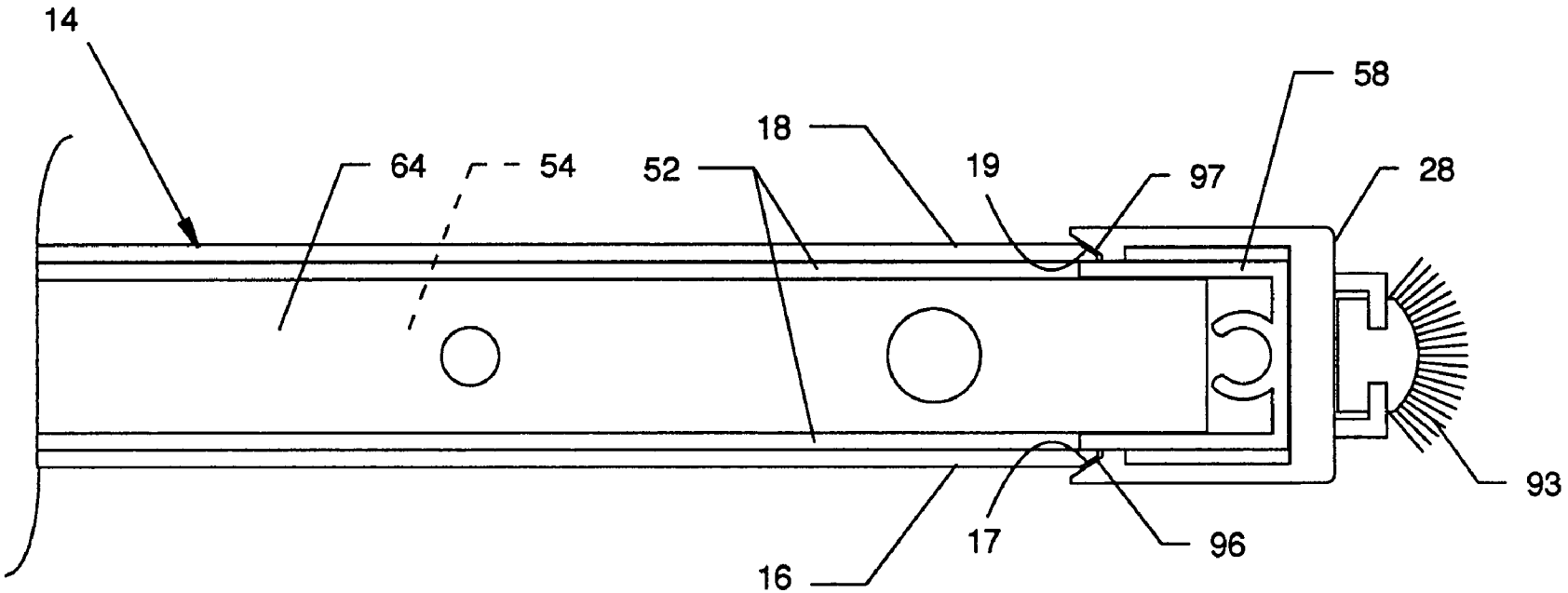
FIG. 5, a top view, illustrates the alignment of several components of the expandable panel assembly with the right side channel.

FIG. 5, a top view, illustrates the alignment of several components of the expandable panel assembly 14 with the right side channel 28. Opposed angled interior edges 96 and 97 of the right side channel 28 assist alignment of the right sleeve channel 58 as well as provide structure for capture of the front cover slide plate 16 and the rear cover slide plate 18, as later described in detail. Front cover slide plate 16 and rear cover slide plate 18 also include beveled edges 17 and 19 that are preferably complementary to and face the opposed angled interior edges 96 and 97, respectively. When right side channel 28 is tightened inwardly, the beveled edge 17 is engaged and held by angled interior edge 96 and beveled edge 19 is engaged and held by angled interior edge 97. When right side channel 28 is loosened outwardly, beveled edge 17 can slide vertically with respect to angled interior edge 96 and beveled edge 19 can slide vertically with respect to angled interior edge 97. If the outward loosening is not excessive, front cover slide plate 16 and rear cover slide plate 18 may remain captured but vertically slidable and then be subsequently reversibly secured at a desired elevation by tightening inwardly with the right side channel 28. The provision of bevels 17 and 19 on the cover slide plates 16 and 18 in combination with the angled inward edges 96 and 97 extends the range of non-excessive loosening wherein the plates remain captured but slideable, relative to that which would be observed if the cover slide plates had only square or non-beveled edges interacting with angled inward edges 96 and 97. Such an arrangement allows for convenient access to internal adjustment parts beneath the front and rear cover slide plates and allows the installation of the pet door panel insert with fewer personnel since the slide plates can be conveniently secured at a desired elevation.

Figure 6:
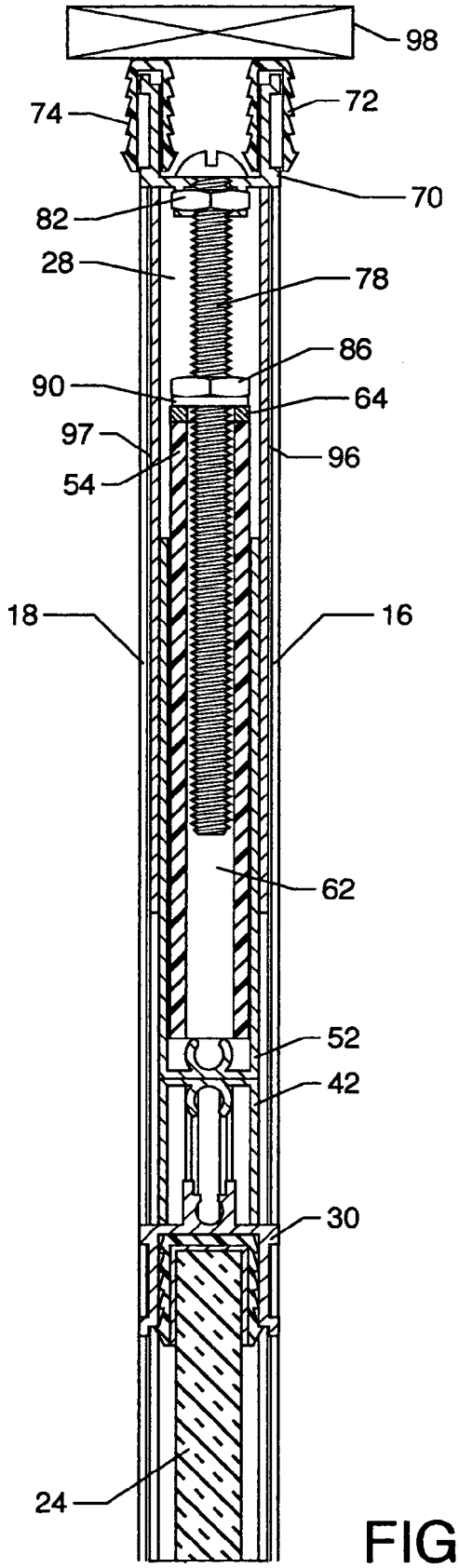
FIG. 6 is a cross section view along line 6—6 of FIG. 1 where the front cover slide plate and the rear cover slide plate have been included; and, FIG. 7 is a view of the elements of FIG. 4 where the front cover slide plate has been slidably repositioned upwardly.

FIG. 6 is a cross section view along line 6—6 of FIG. 1 where the front cover slide plate 16 and the rear cover slide plate 18 have been included. Illustrated in particular is the fixation of the nut 82 within the lower region of the top engagement channel 70, as well as the relationship of other structures of the instant invention. This cross section view depicts the top engagement channel 70 and weatherstrips 72 and 74 engaging a door frame top member 98.

Figure 7:
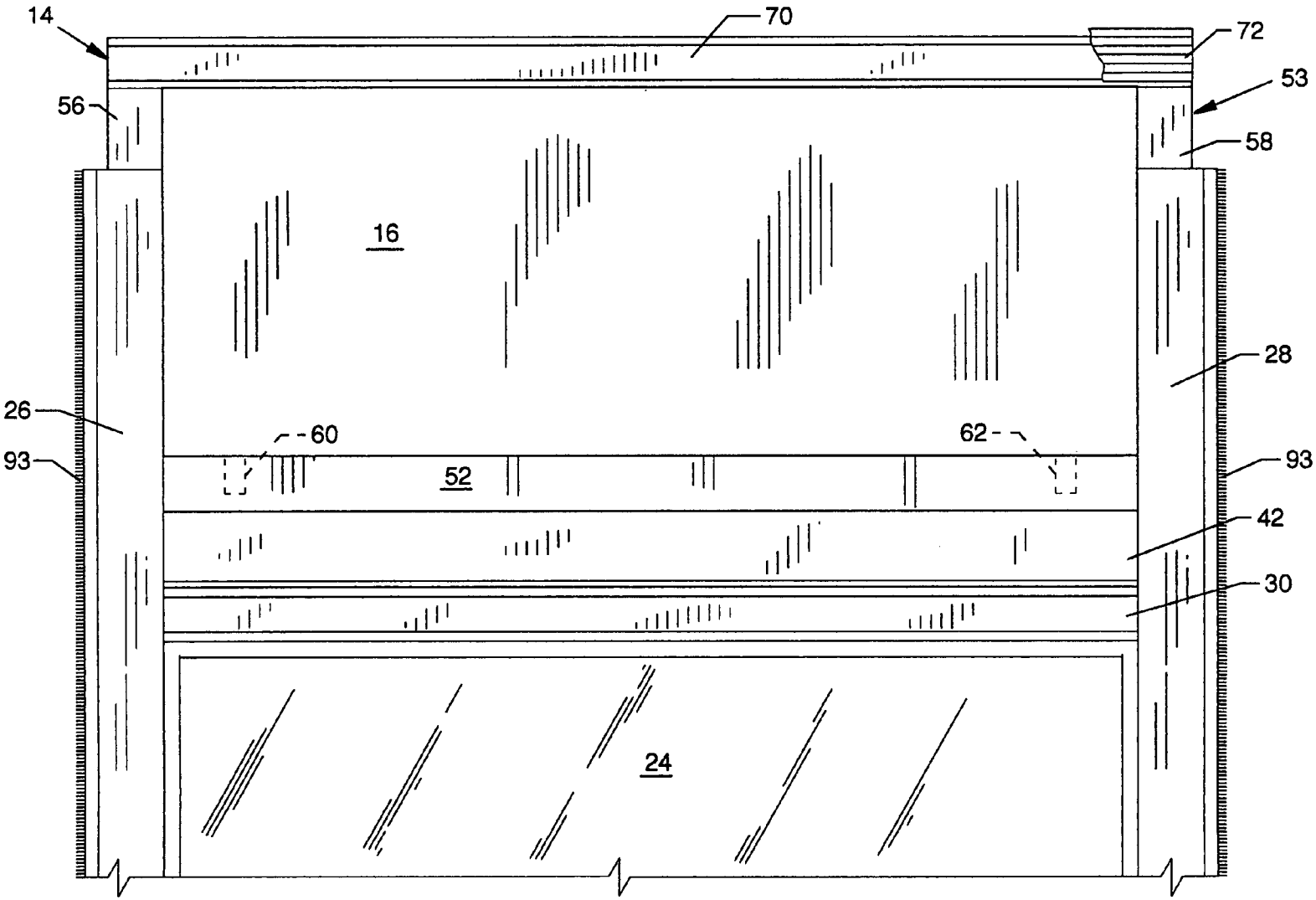

FIG. 7 is a view of the elements of FIG. 4 where the front cover slide plate 16 has been slidably repositioned to cover the space between the front lower edge of the top engagement channel 70, the inner front edges of the left sleeve channel 56 and the right sleeve channel 58, and the front edge of the apertured plate 64, as well as the hardware therebetween. The rear cover slide plate 18 positions in the same manner.

Mode of Operation

The pet door panel insert 10 can be installed in a door structure such as a sliding glass patio door structure between the stationary door panel and adjacent door frame members at the stationary door panel end or against the door frame adjacent to the door frame members at the operator door panel end. The lower framework channel of the pet door panel insert 10 rests on the sill of the door frame and one of the vertically aligned framework side channels aligns to either of the door jambs. The vertically expandable panel assembly 14 is slidably engaged and positionably and expandingly adjustable in the upper vertical portions of vertically aligned side channels of the framework and is incorporated to secure and to fix the top of the pet door panel insert 10 to an existing door frame top member, channel or track at the top of the door frame.

The pet door panel insert 10 is set in the chosen location after first ensuring that the expandable panel assembly 14 is at the lowest vertical position or that it is not extended to an extent that would disallow fitting of the pet door panel insert 10 into the confines of the door frame. The bottom engagement channel 36 with weatherstrips 38 and 40 is then aligned to the door sill. The left adjustment nut 84 and the right adjustment nut 86 are then rotated manually or with the assistance of a small wrench, preferably in simultaneous clockwise rotation. Such rotation provides jackscrew-like operation where the left adjustment nut 84 and the right adjustment nut 86, which bear in direct intimate contact with the apertured plate 64 which in turn bears directly on the upper surface of the filler panel 54, reactingly urges the elongated machine screws 76 and 78 upwardly. Such upward movement of the elongated machine screws 76 and 78 also causes the remaining portion of the positionable structure 53 to be expanded upwardly until the weatherstrips 72 and 74 of top engagement panel 70 suitably engage the door frame member 98. Upward positioning or expansion of the expandable panel assembly 14 is guided by the upper regions of the left side channel 26 and the right side channel 28 in sliding engagement over and about the exterior portions of the left sleeve channel 56 and the right sleeve channel 58, respectively, and by the sliding engagement of the interior portions of the left sleeve channel 56 and the right sleeve channel 58 over and about the ends of the filler panel 54 which extend beyond the extended wall cross channel 52. The front cover slide plate 16 and rear cover slide plate 18 are firmly engaged between the angled interior edges 96 and 97 of the left side channel 26 and the right side channel 28, as well as intimately engaged against opposed sides of the extended wall cross channel 52. One or more screws of either screw pair consisting of screws 44 and 48 or screw pair consisting of screws 46 and 50 may require a slight rotation to be backed off a few turns to be loosened to allow a slight outward repositioning of the appropriate left or right side channel 26 or 28 with respect to one of the outer ends of the top cross channel 30 and the full length top cross channel 42. Such repositioning relaxes the frictional engagement of the angled interior edges 96 and 97 of the left side channel 26 and the right side channel 28 against the vertically aligned ends of the front cover slide plate 16 and the rear cover slide plate 18 so that the front cover slide plate 16 and the rear cover slide plate 18 can be slidingly repositioned along the angled interior edges 96 and 97 of the left side channel 26 and the opposed sides of the extended wall cross channel 52, as shown in FIG. 7, thereby covering the space between the lower edges of the top engagement channel 70, the inner edges of the left sleeve channel 56 and the right sleeve channel 58, and the edges of the apertured plate 64, as well as covering the hardware therebetween. Subsequent to positioning of the front cover slide plate 16 and the rear cover slide plate 18, the appropriate screws are retightened to draw the left or right side channels 26 or 28 inwardly to positionally tightly secure the front cover slide plate 16 and the rear cover slide plate 18 in place between the angled interior edges 96 and 97 of the left side channel 26 and the right side channel 28. Positioning of the front and rear slide plates 16 and 18 completes the sealed barrier between the outside environment and the inside environment and along with the underlying structure, including the extended wall cross channel 52, the full length top cross channel 42 and the top cross channel 30, and provides an aesthetically pleasing overall appearance from both sides of the pet door panel insert 10.

One may appreciate that the expandable panel assembly of the present invention could also be used in an alternative configuration wherein expansion occurs at the bottom of a pet door panel insert and serves to raise the entire pet door panel insert assembly situated thereabove. In such an alternative configuration, the capacity to raise and hold the cover slide panels in a convenient raised position facilitating access to the adjustment nuts is particularly useful. Additionally, in a third alternative, an expandable panel assembly may be provided at both the top and bottom of a pet door panel insert. Such an alternative configuration would allow the height of the pet passage and associated door to be altered. For example, as a young puppy grows and matures, the desired position of the pet passage and associated door may be raised once or in several steps by reducing the expansion at the top and increasing the expansion at the bottom. Additionally, one may appreciate that internal spaces, such as the spaces between the cover slide plates, may be insulated to further increase the energy efficiency of the pet door panel insert. Such insulation may be a block of foam insulating material sized to fit within the space between the sliding cover plates or foam-in-place type insulation injected into the space subsequent to installation. The foam-in-place insulation may be included as a component of kit including the pet door panel insert, instructions, and a can of foam-in-place insulation.

Various modifications can be made to the present invention without departing from the apparent scope thereof.

PARTS LIST

| | |
|---|---|
| 10 | pet door panel insert |
| 12 | framework |
| 14 | expandable panel assembly |
| 16 | front cover slide plate |
| 17 | front bevel edge |
| 18 | rear cover slide plate |
| 19 | rear bevel edge |
| 20 | pet entry framework |

-continued

| | |
|---|---|
| 22 | pet door |
| 24 | window panel |
| 26 | left side channel |
| 28 | right side channel |
| 30 | top cross channel |
| 32 | lower region cross channel |
| 34 | bottom cross channel |
| 36 | bottom engagement channel |
| 38 | weatherstrip |
| 40 | weatherstrip |
| 42 | full length top cross channel |
| 44 | screw |
| 46 | screw |
| 48 | screw |
| 50 | screw |
| 51 | stationary structure |
| 52 | extended wall cross channel |
| 53 | positionable structure |
| 54 | filler panel |
| 56 | left sleeve channel |
| 58 | right sleeve channel |
| 60 | body hole |
| 62 | body hole |
| 64 | apertured plate |
| 66 | screw |
| 68 | screw |
| 70 | top engagement channel |
| 72 | weatherstrip |
| 74 | weatherstrip |
| 76 | elongated machine screw |
| 78 | elongated machine screw |
| 80 | left nut |
| 82 | right nut |
| 84 | left adjustment nut |
| 86 | right adjustment nut |
| 88 | left lock washer |
| 90 | right lock washer |
| 92 | screw |
| 93 | weatherstripping |
| 94 | screw |
| 96 | angled interior edge |
| 97 | angled interior edge |
| 98 | door frame top member |

What is claimed is:

1. A pet door panel insert suitable for reusable temporary installation within a plurality of sliding glass patio doors, each of the sliding glass patio doors having a stationary door panel and an operator door panel, the pet door panel insert comprising:

a) a framework, the framework having right and left side channels and a plurality of horizontal cross channels aligned with the side channels;

b) a lower entry panel, the lower entry panel having a pet passage and a door operable by a pet closing the pet passage, the lower entry panel mounted between the right and left side channels and between a lower pair of cross channels;

c) an upper vertically expandable panel assembly, the upper vertically expandable panel assembly mounted between the right and left side channels and above an upper cross channel, the vertically expandable panel assembly having a top engagement channel with left and right sleeve channels depending therefrom and captured in slidingly engagement by the left and right side channels and a full length top cross channel, the top engagement channel thereby being vertically mobile relative to the full length top cross channel;

d) means to vertically adjust the top engagement channel spacing above and relative to the full length top cross channel; and, e) at least one mid-panel between the lower entry panel and the upper vertically expandable channel.

2. The pet door panel insert of claim 1, wherein the means to vertically adjust include a screw drive mechanism.

3. The pet door panel insert of claim 2, wherein the screw drive mechanism includes a pair of vertically oriented threaded screws.

4. The pet door panel insert of claim 3, wherein the screws are rotatable and fixed in vertical relationship to the top engagement channel and driven vertically against the full length top cross channel.

5. The pet door panel insert of claim 2, wherein an adjustment nut engages the screw drive mechanism and bears against the full length top cross channel.

6. The pet door panel insert of claim 1, wherein the mid-panel is transparent.

7. The pet door panel insert of claim 1, wherein the plurality of sliding glass doors includes sliding glass doors of different heights.

8. The pet door panel insert of claim 1, wherein the means to vertically adjust is covered by a cover slide plate.

9. The pet door panel insert of claim 8, wherein the cover slide plate is one of a pair of cover slide plates, one situated on a front of the pet door panel insert and one situated on the rear of the pet door panel insert.

10. The pet door panel insert of claim 9, wherein the cover slide plates are captured by and between the left and right side channels of the framework.

11. The pet door panel insert of claim 10, wherein the left and right side channels have inwardly directed angled interior edges.

12. The pet door panel insert of claim 11, wherein the cover slide plate is one of a pair of opposed cover slide plates, each of the cover slide plates having beveled edges, the beveled edges being complementary to the angled interior edges of the left and right side channels.

13. The pet door panel insert of claim 12, wherein the left and right side channels can be loosened outwardly to allow the cover slide plates to slide vertically and remain captured between the left and right side channels and tightened inwardly to fix the cover slide plates and prevent sliding thereof.

14. The pet door panel insert of claim 10, wherein the left and right side channels may be tightened inwardly or loosened outwardly.

15. The pet door panel insert of claim 14, wherein the left and right side channels tight inwardly to fix the slide cover plates and prevent sliding thereof.

16. The pet door panel insert of claim 15, wherein the left and right side channels loosen outwardly to release the slide cover plates and allow sliding thereof.

17. The pet door panel insert of claim 8, wherein the cover slide plate has a bevel edge.

18. The pet door panel insert of claim 1, further comprising:

a) weatherstrip on the top and lower cross channels; and, b) weatherstripping on the left and right channels.

19. The pet door panel insert of claim 1, wherein the left or right side channel is loosened by rotating a screw engaging the full length top cross channel.

20. The pet door panel insert of claim 19, wherein the screw is one of a pair of screws, the screw being horizontally directed through the respective channel and into the full length top cross channel.

21. An expandable panel assembly, suitable for vertical expansion of a pet door panel insert, having vertical left and right side panels and an upper cross channel mounted thereto, the expandable panel assembly comprising:

a. a top engagement channel, the top engagement channel slideably mountable to a left and right side channels of the pet door panel and above the upper cross channel, the top engagement channel having left and right sleeve channels depending therefrom and adapted to be slidably captured between the left and right side channels, and a full length top cross channel, the top engagement channel thereby being vertically mobile relative to the full length top cross channel; and, b. means to vertically adjust the top engagement channel spacing above and relative to the full length top cross channel.

22. The expandable panel assembly of claim 21, wherein the means to vertically adjust includes a screw drive mechanism.

23. The expandable panel assembly of claim 21, further comprising a cover slide plate adapted to be captured between the left and right side channels.

24. The expandable panel assembly of claim 23, wherein the cover slide plate is one of a pair of cover slide plates, one of the cover slide plates being slideably captured on a front of the expandable panel assembly and one of the cover slide plates being captured on a back of the expandable panel assembly.

25. A method of installing a pet door panel insert in a sliding glass door with an openable operator panel and a stationary panel carried in a frame including an upper frame, the method including the steps of:

a. providing a pet door panel insert, the pet door panel insert having an upper vertically expandable panel assembly, the upper vertically expandable panel assembly having an engagement cross channel driven by a jack screw drive with left and right adjustment nuts;

b. setting the insert into an open portion of the frame of the sliding glass door;

c. rotating the left and right adjustment nuts to raise the engagement cross channel into engagement with the upper frame of the sliding glass door; and, d. sliding the operator panel of the sliding glass door partially closed to capture the insert in the frame.

26. The method of claim 25, wherein the pet door panel insert further includes a slide cover plate captured in the frame and further including the steps of:

a. sliding the cover slide plate to expose the left and right adjustment nuts; and, b. resliding the cover slide plate to cover the left and right adjustment nuts.

27. The method of claim 26, wherein the frame may be tightened to fix the elevation of the cover slide plate or loosened to allow the captured cover slide plate to slide vertically.

28. The method of claim 26, wherein the cover slide plate is one of pair of clover slide plates, the cover slide plates of the pair being situated at the front and back of the pet door panel insert.

29. The method of claim 28, wherein the cover slide plates have beveled edges and the frame has complementary angled interior edges for the receipt thereof.

* * * * *